US006332294B1

(12) United States Patent
Carranza

(10) Patent No.: US 6,332,294 B1
(45) Date of Patent: Dec. 25, 2001

(54) CONSTRUCTION OF MECHANICAL DRAFT EXCLUDERS FOR THE LOWER PART OF JAMBS

(76) Inventor: Luis Müller Carranza, Carretera Nacional II, Km. 774,5 - La Jonquera (Girona) (ES)

( * ) Notice: Subject to any disclaimer, the term of this patent is extended or adjusted under 35 U.S.C. 154(b) by 0 days.

(21) Appl. No.: 09/515,642

(22) Filed: Feb. 29, 2000

(30) Foreign Application Priority Data

Mar. 2, 1999 (ES) ..... 9900501
Dec. 30, 1999 (ES) ..... 200000067

(51) Int. Cl.[7] ..... E06B 1/04

(52) U.S. Cl. ..... 52/204.1; 52/212; 52/207; 52/217; 49/505

(58) Field of Search ..... 52/204.1, 212, 52/730.3, 734.1, 207, 217; 49/468, 505, 504

(56) References Cited

U.S. PATENT DOCUMENTS 2,697,932 * 12/1954 Goodwin ..... 52/217
3,667,192 * 6/1972 Sewell ..... 52/213
3,778,931 * 12/1973 Donaldson ..... 49/380
3,796,006 * 3/1974 Dixon ..... 49/493
4,092,394 * 5/1978 Dixon ..... 264/210
4,539,784 * 9/1985 Allen ..... 52/217
4,555,882 * 12/1985 Moffitt et al. ..... 52/204
4,703,586 * 11/1987 Smith et al. ..... 49/307
4,765,094 * 8/1988 Gemmell ..... 49/475
5,426,894 * 6/1995 Headrick ..... 49/468
5,475,946 * 12/1995 Howe ..... 49/470
5,553,419 * 9/1996 Jenkins, II ..... 49/469
5,588,266 * 12/1996 Headrick ..... 52/204.1
5,611,173 * 3/1997 Headrick et al. ..... 49/468
6,041,560 * 3/2000 Larson et al. ..... 49/468
6,082,047 * 7/2000 Comaglio et al. ..... 49/308

* cited by examiner

*Primary Examiner*—Beth A. Stephan
*Assistant Examiner*—Dennis L. Dorsey
(74) *Attorney, Agent, or Firm*—Dennison, Scheiner, Schultz & Wakeman

(57) ABSTRACT

The invention consists of several improvements introduced into the construction of mechanical draft excluders for the lower edge of doorjambs, characterized in that the body of the draft excluder is built in three sections aligned horizontally, with the two end sections each connected to a side of the doorjamb and the third laid out in a sliding fashion between the two to cover the separation that might exist between the two fixed end sections by adapting to the width of the door.

14 Claims, 3 Drawing Sheets

CONSTRUCTION OF MECHANICAL DRAFT EXCLUDERS FOR THE LOWER PART OF JAMBS

FIELD OF THE INVENTION

The purpose of the invention consists of two improvements included in the construction of mechanical draft excluders for the lower part of jambs.

BACKGROUND OF THE INVENTION

Draft excluders are known for blocking the passage of air between the edge of a door and the ground, from those which function statically to those which, being elevated during the movement of the door, automatically descend to close them.

Specifically, the invention's improvements are related to elevated automatically-descending draft excluders.

The aforementioned automatic draft excluders, when they are installed, have the problem that the elongated elements that comprise them must be cut according to the measurements of the door where they are going to be placed and adapted to it, which requires the purchaser of the draft excluder to go to a specialized draft excluder installer, since he is unable to install it himself.

SUMMARY OF THE INVENTION

The improvements covered by the invention have been created to facilitate the work of installing the draft excluder by the non-specialist user.

With these improvements, a user who wishes to install the draft excluder himself is not required to saw or cut any of the parts that comprise the body of the draft excluder, given that it has the advantage that it can include a wide range of door widths and the user only has to regulate and fix the width according to the width of the door where it must be installed.

Thus the improvements allow the user to purchase the draft excluder in the form of a kit with all the elements required for its custom installation, following simple installation instructions. It is obvious that the user will thereby avoid having to call an expert installer to install the draft excluder, thereby saving the money and also gaining the satisfaction of having performed the installation himself.

BRIEF DESCRIPTION OF THE DRAWINGS

For correct interpretation, a practical installation case is described below, in order to show one method, though not the only method, for performing the installation, accompanied by diagrams which show the following.

DETAILED DESCRIPTION OF A PREFERRED EMBODIMENT

Figure 1:
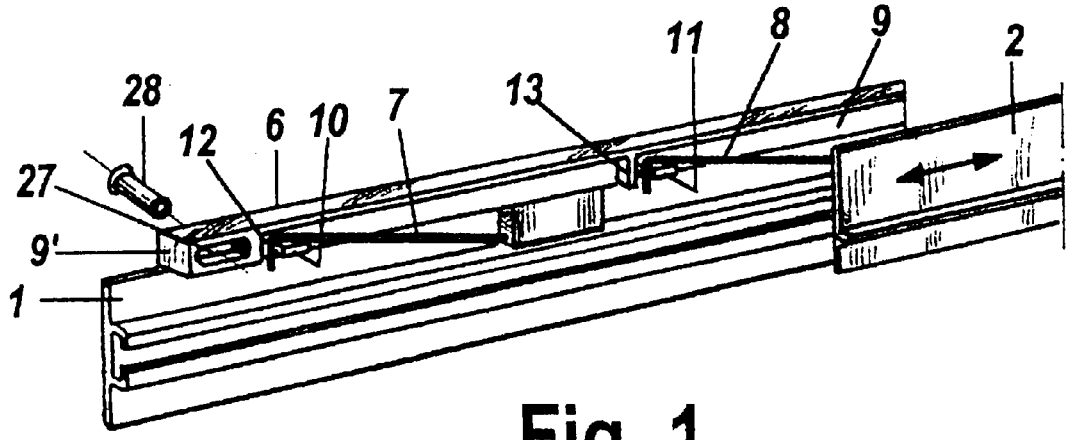
FIG. 1 shows an exploded view and perspective of the draft excluder obtained from these improvements.
Figure 2:
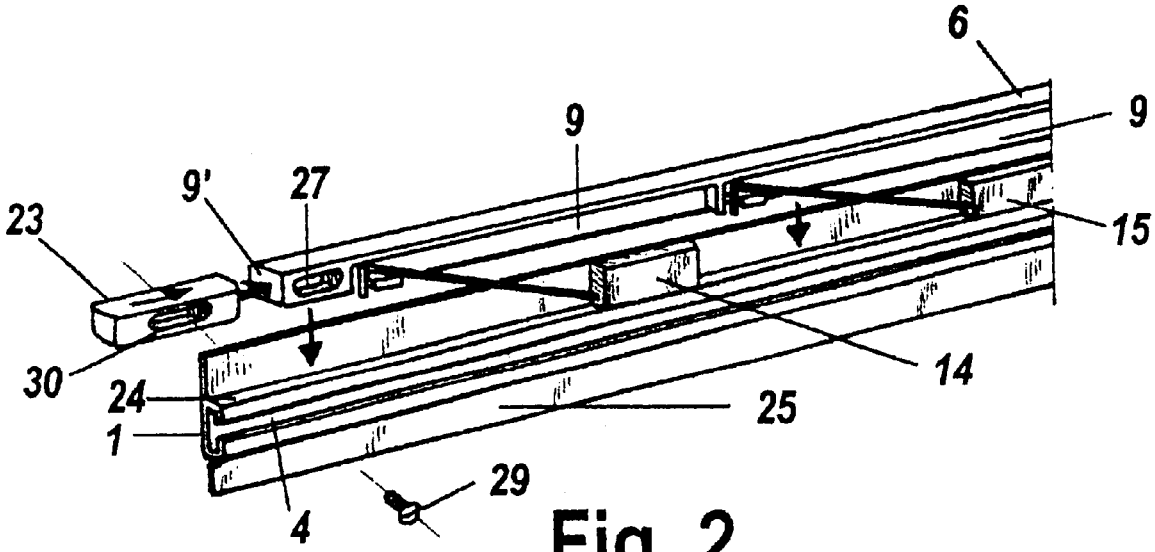
FIG. 2 shows the same draft excluder with its constituent parts partially mounted.
Figure 3:
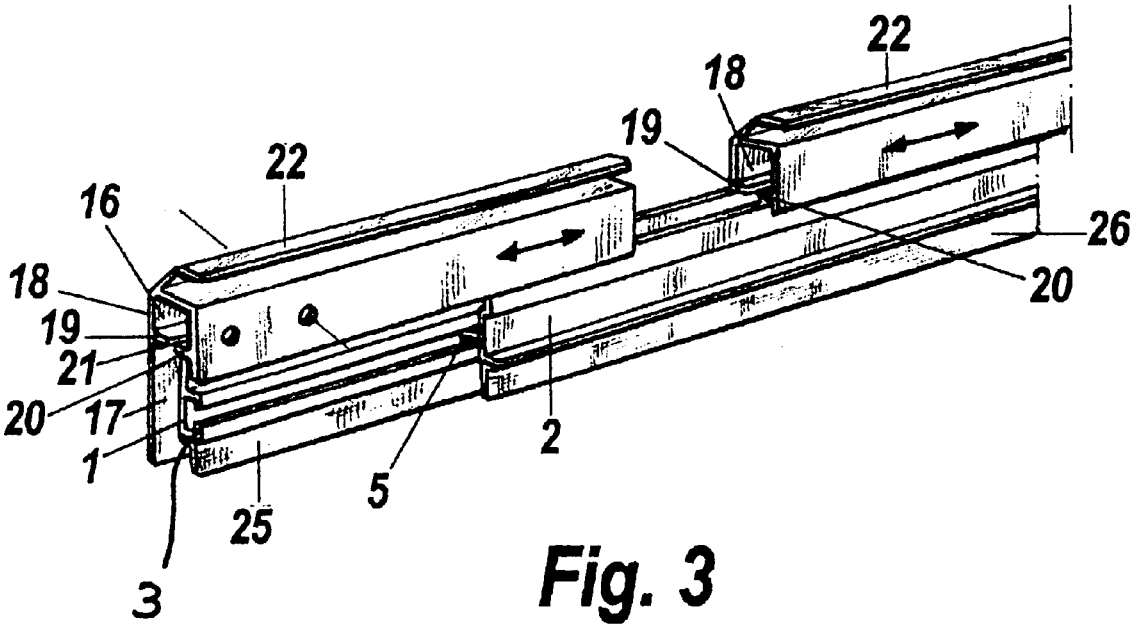
FIG. 3 is a perspective of the parts of the draft excluder mounted without the static central coverage section.
Figure 4:
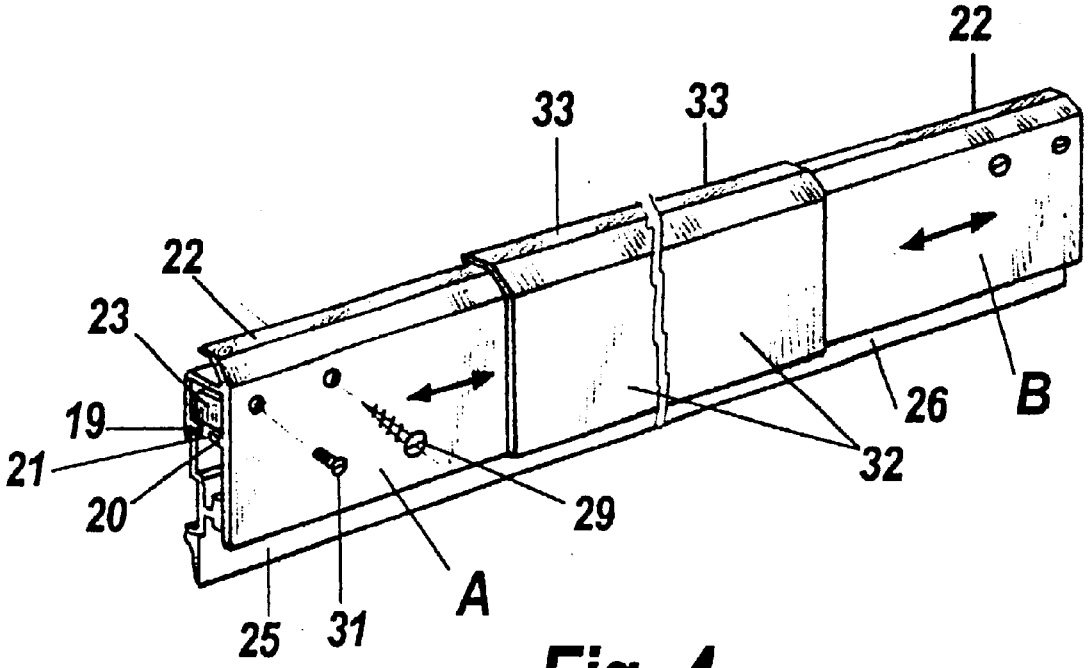
FIG. 4 is a 180° view of the preceding figure, with its parts mounted with the central part cut and without including the assembly's supplementary affixing screws.
Figure 5:
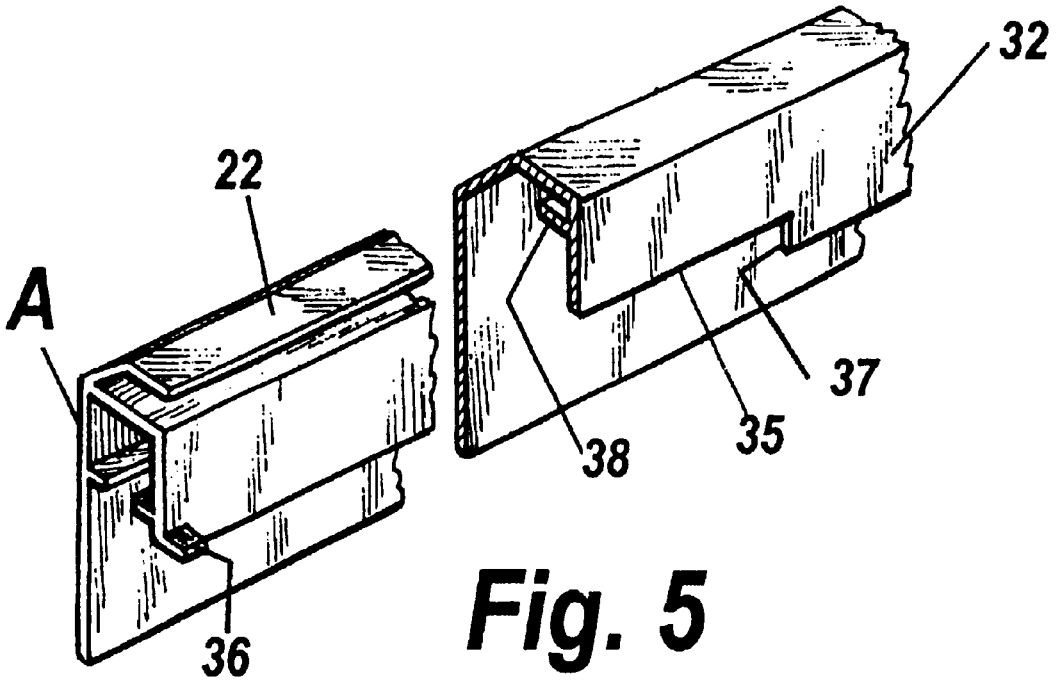
FIG. 5 represents the two facing sliding sections laid out in perspective without the central section, with one of those ends sectioned vertically.
Figure 6:
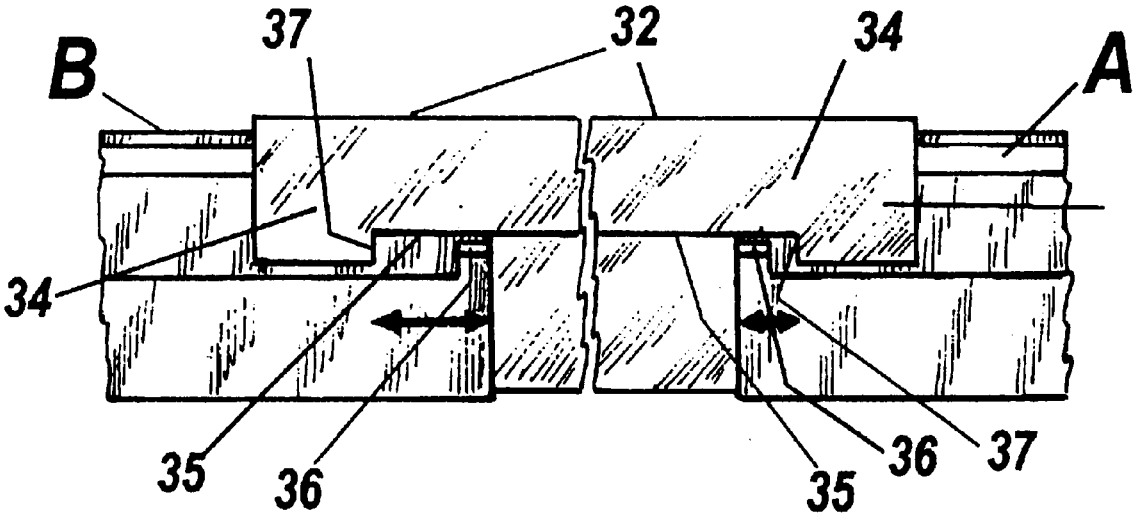
FIG. 6 represents the basic pieces of the improved draft excluder, without showing for improved interpretation the drive mechanisms, with a lower plan view of the three mounted pieces and the partially cut central section.

The invention consists of the body of the composition-type draft excluder's being comprised of two separate sections ("A" and "B"), laid out in line and a third section (32), located between the two preceding ones, facing each other and set by bolts and sliding with the first two.

Each section ("A" and "B") is comprised of a core made up of two metallic panel sections (1 and 2), with one affixed to the side of the other and able to slide laterally without being able to be separated by perpendicular traction.

For this, one of the two central pieces (1) has a continuous rectangular section box (3) centered and projecting over it along its length, with a side opening (4) into which the continuous, flat-lying T-shaped projecting head (5) of the other central, sectioned, juxtaposed and fastened piece (2) is inserted headfirst and slid laterally; [the pieces] interlock once the custom installation is complete.

The ends of the upper plates of each of the two juxtaposed and crimped-together pieces of the core (1 and 2) are separated, forming a continuous separation between both (24) in which are inserted sections of the horizontal arms (6) into which the bent upper ends of various spring rods (7 and 8) are affixed.

Each section of the sliding rectangular section (6) has a horizontal notch (9) from which crimp stops (10 and 11) extrude perpendicularly, where the upper end bent into a straight angle is set, descending from the respective spring rod (7 or 8); the bent upper end of the rod is housed between the edge of the stop (10 or 11) and the respective adjacent vertical wall (12 or 13) of the horizontal notch (9).

Support chocks (14 and 15) are placed below the sections acting as sliding arms (6). The lower end of the respective tilted spring-rod (7 or 8) is anchored on the lower edge of the side of each of the support chocks.

Each chock (14 and 15) is supported by its lower base on the internal surface of the continuous horizontal base of the base of a box (24) obtained by juxtaposing the two metallic panel sections (1 and 2).

The end sections ("A" and "B") of the draft excluder are formed from one piece (17) covering the inverted L sections (1 and 2) that comprise a rectangular section internal lengthwise box (16) housed in the sliding sections of the arm (6).

The internal inverted "L" (17) continuous box (16) has an inverted "U" transversal section and two internal ribs project over the internal surface of the two arms facing each other, which are laid out horizontally (19 and 20) along said walls, with a continuous lengthwise separation (21) existing between both which form the interrupted base (18) of the aforementioned box (16).

A broken line flange (22) cuts along the external upper angle of said angle of the aforementioned piece (17), whose flange is bent and elevated on a slant above the external part of the base of the inverted "U" of its own box (16).

The sections of the sliding arms (6) are inserted headfirst, slid laterally and abutting each other on the internal walls descending from the inverted "L" section (17).

A mobile stop (23) with the ability to be partially extended is also inserted into either end of the box (16), according to whether the opening and closing of the door jamb is on the right or the left, projecting beyond the body of the draft excluder, with the ability to be concealed automatically when its end touches the progressively tilted supper surface of a fixed rocker arm (not shown), placed on the door's lintel.

During the movement of the jamb itself during its opening and closing phases, the mobile rocker arm (23) is gradually pressured through the ramp of the fixed stop of the doorframe, driving the mobile stop (23) and with this the head (9') of the section of the sliding arm (6) to which it is juxtaposed is pushed and, once the antagonistic action of the spring rods (7 and 8) has concluded, it causes the descent of the flexible panel holder section (25 and 26), returning to its original starting position once the mobile rocker arm chock (23) stops when it exceeds the gradual stop area of action of the fixed chock connected to the door frame.

A runner hole (27) is made at the ends of each sliding section (6) comprising the mobile header, which is traversed by a metallic eyelet (28) whose projecting edges are riveted against the external descending surfaces of the inverted "L" metallic panel (17) when the draft excluder is mounted.

The runner hole (27) with its transverse metallic eyelet (28) allows and limits the lateral advancement of each section of the sliding arm (6).

The metallic eyelet (28) also allows the corresponding connecting screw (29) to pass through it.

A rectangular opening (30) with smaller sides arched to house the end of a transverse stop screw (31) is also made in one of the two larger faces of the partially emerging mobile stop (23).

Another intermediate metallic panel section (32) covering the outside of the separation that might exist between the external sections ("A" and "B") of the body of the partially formed draft excluder is placed between said sections ("A" and "B").

The covering metallic panel section (32) is also an inverted "L" section and also has a lengthwise flange (33) with an edge bent inwards, with a knurling, knurled or other (not shown) surface, to avoid possible separation from traction and the slipping of the two surfaces of the crimped flanges (22 and 33).

Like the metallic covering section of the inverted "L" piece (22), the part (33) of the metallic section (32) also has an inverted "U" transversal section and an internal rib set horizontally (38) projects beyond the internal surface of its two arms facing each other, which does not reach the opposite wall and which serves as a crimping bush to be inserted headfirst and slid laterally in the cavity formed by the upper flange (22) of the draft excluder's sections ("A" and "B").

The intermediate piece (32) can be slid over the two section ("A" and "B") of the formed assembly by thus covering the view of the possible separation between both sections ("A" and "B") of said assembly for which reason, with specific dimensions, the draft excluder is adaptable, to measure, to the different widths of doorframes, without it being required to saw any of its constituent parts.

An inverted "U" slot is made in the lower edge of the descending skirt (34) with a smaller width than the central section, which reaches the appropriate opposite point of the total length of the skirt.

Several rectangular supports (36) bent in a straight angle are made to emerge perpendicular to the sliding sections ("A" and "B") at the ends of the smaller width skirt of each of said sections, which abut the respective vertical wall (37) of the slot (35) of the central section (32).

Thus each laterally sliding section ("A" and "B") has a stop sliding out of its housing in the static central section (32).

Therefore, what is achieved is that the new draft excluder can be sold to the public in the form of a kit so that the buyer may install it easily and enjoyably.

Obviously, in the present case there will be variables whose details will not alter, change or modify the essence of the invention.

What is claimed is:

1. A mechanical draft excluder for a lower edge of a doorjamb, comprising:

a body having a first section, a second section, and a third section ("A", "B", and 32), aligned horizontally wherein said second section is disposed between said first and said third sections, said first and said third sections ("A" and "B") each connected to a side of the doorjamb and locked with one another; the third section (32) is slidably disposed on opposing free ends of the first and the second sections, said third section (32) being slidable laterally to cover a separation between two internal ends of the first and the second sections (A and B).

2. The mechanical draft excluder of claim 1, wherein a central part of the body of said draft excluder further comprises a core having first and second metallic sections (1 and 2), said first metallic section having a longitudinal lateral opening (4) along the length thereof; said second metallic section having a T-shaped flange (5) along the length thereof, said T-shaped flange (5) being slidably inserted in said longitudinal lateral opening (4), thereby securing said first metallic section to said second metallic section in juxtaposition.

3. The mechanical draft excluder of claim 2, further comprising an inverted metallic "L" panel (17) secured on said juxtaposed first and second metallic sections (1 and 2 and forming a core, said inverted "L" panel includes a continuous box (16) having a pair of elongated flanges (19 and 20) in a facing relation forming a continuous opening (21) therebetween.

4. The mechanical draft excluder of claim 3, wherein said first and said second metallic sections (1 and 2) have juxtaposed upper ends within said continuous box.

5. The mechanical draft excluder of claim 4, further comprising a sliding arm (6) disposed within said continuous box (16) of said inverted metallic "L" panel (17); a first and a second spring rod (7 and 8) each having a first end and a second end; a first parallelepiped body and a second parallelepiped body, said first end of said first spring rod secured to said sliding arm and said second end secured to said first parallelepiped body, and first end of said second spring rod secured to said sliding arm and said second end of said second spring rod secured to said second parallelepiped body; and a chock (23) partially emerging from a side of the body of the draft excluder in a right or left doorjamb opening direction.

6. The mechanical draft excluder of claim 5, further comprising a first stop (10) for crimping a bent portion of said first spring rod, and a second stop (11) for crimping a bent portion of said second spring rod (8), said first and second stops projecting from a notch (9) in said sliding arm (6), said bent portion of said first spring rod being crimped between said first stop and a first adjacent vertical wall (12) of the notch (9), and said bent portion of said second spring rod being crimped between said second stop and second adjacent vertical wall (13) of said notch.

7. The mechanical draft excluder of claim 6, wherein said sliding arm (6) includes a horizontal runner hole (27) for receiving a metallic eyelet (28) having riveted edges.

8. The mechanical draft excluder of claim 7, wherein a first end of said sliding arm (6) is crimped with ends of said first and second metallic bars (7 or 8) said rocker arm is pushed when the jamb is closed and touches the tilted surface forming a ramp for a static stop fixed to the doorframe, wherein pushing said rocker presses said rocker against the first end (9') of said sliding arm (6) whereby flexible first and second panels (25 and 26) descend when said first and second spring rods (7 and 8) are released.

9. The mechanical draft excluder of claim 8, further comprising an elongated horizontal cavity (30) within said chock (23) to house a transverse screw (31) therewithin, thereby limiting the lateral movement of the chock.

10. The mechanical draft excluder of claim 9, wherein said first and second metallic sections (1 and 2) each include an upper side adjacent to an internal surface of a descending wall of said inverted metallic "L" panel (17).

11. The mechanical draft excluder of claim 10, wherein a broken line flange (22) extends at an angle from an upper edge of said inverted "L" metallic panel.

12. The mechanical draft excluder of claim 11, wherein said third section (32) further comprises an elongated metallic panel (33) attached and crimped and abutting said inverted metallic "L" panel (17) wherein the edge of its respective flange is bent inward (38) to achieve the crimping of said broken line flange and said elongated panel (22 and 33) of said draft excluder.

13. The mechanical draft excluder of claim 12, wherein said inverted "L" metallic panel (17) further comprises a plurality of perpendicular holes, a transverse metallic eyelet (28) receivable within said runner hole (27) of said sliding arm (6), wherein outer edges of said metallic eyelet (28) are riveted against the descending walls of said inverted "L" section (17) and a connecting screw (29) is placed through said metallic eyelet (28).

14. The mechanical draft excluder of claim 13, further comprising an inverted "U" slot (35) having a descending skirt (34) on said third section and a rectangular support-stop (36) bent in a straight angle in said skirt wherein said first and second sections ("A" and "B") are at the maximum emergence of said third section (32), said respective support-stop (36) abuts a wall (37) of the inverted "U" slot.

* * * * *